US005149137A

United States Patent [19]

Holt

[11] Patent Number: 5,149,137

[45] Date of Patent: Sep. 22, 1992

[54] LOTTO ORGANIZER

[76] Inventor: Lloyd E. Holt, 15861 Oriote La., Huntington Beach, Calif. 92649

[21] Appl. No.: 706,022

[22] Filed: May 28, 1991

[51] Int. Cl.[5] ..... B12D 3/00

[52] U.S. Cl. ..... 281/31; 229/72; 206/39.1

[58] Field of Search ..... 281/31, 45; 229/68 R, 229/72; 206/39, 39.1, 39.7, 425

[56] References Cited

U.S. PATENT DOCUMENTS 4,312,393 1/1982 Green ..... 281/45
4,520,958 6/1985 Jones et al. ..... 281/31
4,803,795 2/1989 Questel et al. ..... 281/45 X

*Primary Examiner*—Timothy V. Eley
*Assistant Examiner*—Willmon Fridie, Jr.
*Attorney, Agent, or Firm*—Beech & Collins

[57] ABSTRACT

The lottery organizer is a device which has an inside and outside cover that has pockets attached to the inside cover to hold various lottery game materials. The pockets are of a size to hold computer input material and output ticket number receipts and protect them from damage. There is a pocket to hold a coin for use with lottery "scratch off" tickets. In addition, a band formed by two slits in the inside cover is provided to hold a pen or pencil. Also, the organizer can be folded in the middle like a wallet for smaller size to be put in a person's pocket. When the organizer is made of vinyl, the pockets may be clear vinyl so their contents can be viewed.

5 Claims, 1 Drawing Sheet

LOTTO ORGANIZER

FIELD OF THE INVENTION

This invention relates to devices for carrying paper materials and writing instruments, and in particular, to devices which are used to carry gaming or lottery tickets, receipts, etc. The new device incorporates a simple pocket arrangement that is particularly useful for lottery information.

DESCRIPTION OF RELATED ART

There currently exists a large number of devices for carrying paper and writing instruments. In this category are wallets for both pockets in clothing and for hand-carrying or use in a purse. Such wallets come in many sizes and shapes, but are usually intended for general purpose use such as to carry money (paper and coins), notes, credit cards, etc. They are also of a general shape to handle a wide variety of objects.

The present invention is specifically designed to handle and protect the computer readable lottery entry tickets and the other materials associated with lottery games. This combines to provide a compact wallet or organizer which protects tickets and receipts from damage in a convenient matter along with other devices such as a pen and a coin for scratch-off lottery tickets.

SUMMARY OF THE INVENTION

A primary objective of the invention is to provide an organizer and holder for the material used in connection with lottery games. This allows paper materials, pens and coins to be conveniently stored and carried. Another object of the invention is to protect the paper materials from damage.

In accordance with the description presented herein, other objects of this invention will become apparent when the description and drawings are reviewed.

DESCRIPTION OF THE PREFERRED EMBODIMENT

The lottery organizer consists of three layers of material in a rectangular shape which has three pockets or compartments on its inside layer. In addition, a means to carry a pen or pencil is provided. All of these compartments provide a means to conveniently carry lottery game material and protect it from damage.

Figure 1:
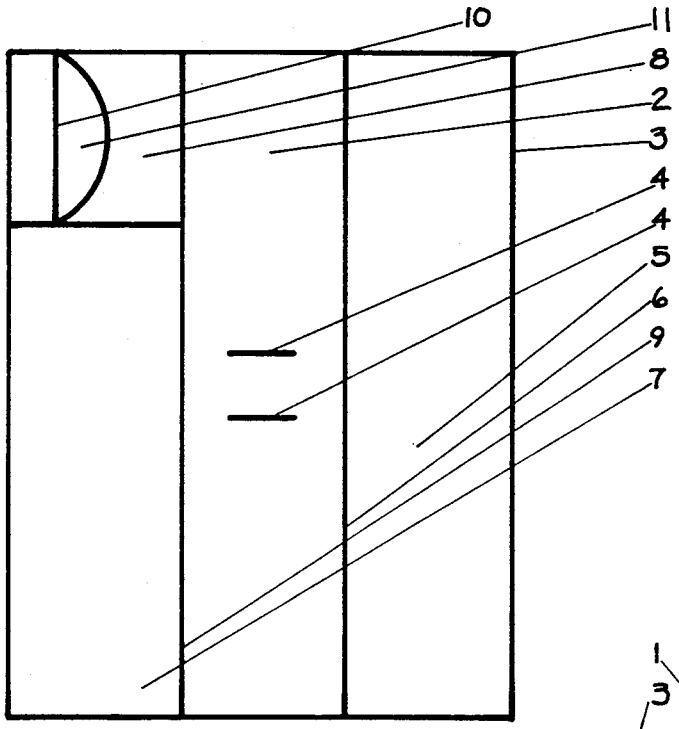
FIG. 1 illustrates the lotto organizer unfolded with the pockets or compartments on the inside.
Figure 2:
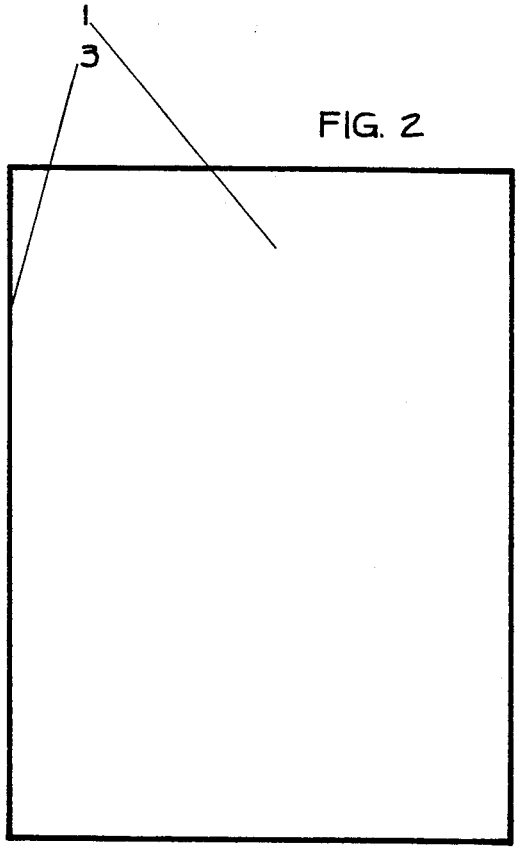
FIG. 2 illustrates the organizer unfolded viewed on the outside surface.
Figure 3:
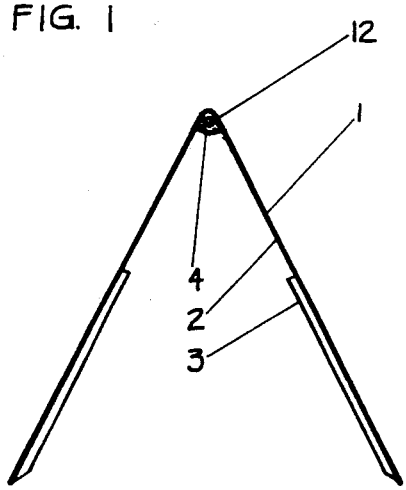
FIG. 3 illustrates an end view of the organizer partially folded.

Referring to FIGS. 1 through 3, the lottery organizer for the Lotto game has an outside cover (1) and an inside cover (2) which are rectangular in shape with dimensions of 8¾ inches by 7½ inches. The inside cover (1) and outside cover (2) are joined by a suitable means around their perimeter (3) or outside edges. In the case where vinyl is used, the perimeter (3) may be joined by a heat-sealing process.

The inside cover (2) has two slits (4) or cuts in its approximate center of sufficient length to allow a pen (12) or pencil to be inserted and retained. The outside cover (1) and inside cover (2) are made of suitable material such that the lottery organizer may be folded at the middle of its shorter dimension.

A ticket entry pocket (5) is attached to the perimeter (3) of the inside cover (2) on three edges leaving the fourth edge (6) open. Thus, this forms a compartment in which lottery computer entry tickets may be inserted and retained. The ticket entry pocket (5) is 8¾ inches by 3 inches rectangular.

A ticket receipt pocket (7) and a coin pocket (8) are formed by attaching a piece of material on three edges to the perimeter (3) of the inside cover (2) on the opposite edge from the ticket entry pocket (5). The attached material is then attached for 1½ inches on one end and attached between the two pockets to form the coin pocket (8) separate from the ticket receipt pocket (7). The ticket receipt pocket (7) is 7¼ inches by 2 ⅝ inches and has an open edge (9) in which lottery receipt tickets may be inserted and retained.

The coin pocket (8) is also attached approximately ½ inch from the perimeter (3) attachment edge to form a hinge (10) for a flap (11) which is a semicircular cut in the material forming the coin pocket (8). The flap (11) can be lifted to insert a coin in the pocket and then serve to retain the coin. The coin pocket (8) thus formed is 2 ¼ inches by 1½ inches.

In the case in which vinyl material is used to make the lottery organizer, the various pockets (5, 7 and 8) may be clear vinyl such that the tickets and other contents may be viewed. Also, when vinyl is used for the outside cover (1) and inside cover (2) the covers may be heat sealed in the middle of the shorter dimension except for the two slits (4) in order to prevent the two covers (1, 2) from separating when folding the organizer.

I claim:

1. A device for retaining lottery game materials comprising:

a. an outside cover and an inside cover of the same dimensions attached around their perimeter;

b. a ticket entry pocket attached to the perimeter of the inside cover on three edges with the fourth edge of the ticket entry pocket open thus forming a compartment of approximately one third to one half the size of the inside cover;

c. a ticket receipt pocket and a coin receipt pocket combination attached to the perimeter of the inside cover on three edges opposite the ticket entry pocket thus forming a compartment of approximately one third to one half the size of the inside cover;

d. wherein the ticket receipt pocket and the coin pocket are attached on a common line between them to the inside cover with the coin pocket approximately one fourth the width of the ticket receipt pocket and each the same depth;

e. wherein the coin pocket is attached on its fourth edge to form a closed pocket which has a semicircular flap which opens to allow access to the coin pocket; and f. the outside cover and the inside cover made of suitable material such that they may be folded in book fashion along a fold line generally equidistant from and parallel to the ticket entry pocket and the opposite ticket receipt pocket and coin receipt pocket wherein the inside cover has two slits across the fold line at its approximate center with the two slits long enough to allow a pen to pass through and be retained.

2. The device as in claim 1 wherein the outside cover, inside cover, ticket entry pocket, ticket receipt pocket and coin pocket material are vinyl; the outside cover and inside cover are attached around their perimeter by pressure heat treatment; and the ticket entry pocket, ticket receipt pocket and coin pocket are attached by pressure heat treatment.

3. The device as in claim 2 wherein the vinyl material for the ticket entry pocket, ticket receipt pocket and coin pocket is a clear see-through vinyl.

4. The device as in claim 2 wherein the outside cover and the inside cover are attached along the fold line, except for the part between the two slits, by pressure heat treatment.

5. The device as in claim 1 wherein the dimensions of the outside cover and inside cover are $8\frac{3}{4}$ inches by $7\frac{1}{2}$ inches, the ticket entry pocket are $8\frac{3}{4}$ inches by 3 inches, the ticket receipt pocket are $7\frac{1}{4}$ inches by $2\frac{5}{8}$ inches, and the coin pocket has a second attached inner seam $\frac{1}{4}$ inches from and parallel to the perimeter to form a hinge for the flap and the dimensions of the coin pocket are $2\frac{1}{4}$ inches by $1\frac{1}{2}$ inches.

* * * * *